United States Patent [19]

Ikehara

[11] Patent Number: 4,605,150

[45] Date of Patent: Aug. 12, 1986

[54] BUTTON SETTING APPARATUS WITH OPTICAL POSITION INDICATOR

[75] Inventor: Ichiro Ikehara, Toyama, Japan

[73] Assignee: Nippon Notion Kogyo Co., Ltd., Tokyo, Japan

[21] Appl. No.: 686,541

[22] Filed: Dec. 26, 1984

[30] Foreign Application Priority Data

Dec. 29, 1983 [JP] Japan ..... 58-200487[U]
Dec. 29, 1983 [JP] Japan ..... 58-200493[U]

[51] Int. Cl.[4] ..... A41H 37/10

[52] U.S. Cl. ..... 227/18; 227/43; 227/115; 227/116; 227/119; 227/156; 33/11; 33/17 R; 33/190; 33/286; 29/720

[58] Field of Search ..... 227/15, 119, 156, 18, 227/30, 43, 115, 116, 149; 29/720, 721; 112/1; 33/11, 17 R, 190, 286, 287; 356/138, 375; 353/40, 84; 408/16

[56] References Cited

U.S. PATENT DOCUMENTS

| | | | |
|---|---|---|---|
| 2,973,688 | 3/1961 | Bilibok | 33/11 |
| 3,130,633 | 4/1964 | Rantsch | 33/286 X |
| 3,728,027 | 4/1973 | Watanabe | 408/16 X |
| 3,831,250 | 8/1974 | Holiday | 29/721 X |
| 3,982,825 | 9/1976 | Mitchell | 353/84 X |
| 4,514,899 | 5/1985 | Burger | 29/721 |

FOREIGN PATENT DOCUMENTS

| | | | |
|---|---|---|---|
| 0934579 | 6/1982 | U.S.S.R. | 29/721 |

*Primary Examiner*—Robert L. Spruill
*Assistant Examiner*—Taylor J. Ross
*Attorney, Agent, or Firm*—Hill, Van Santen, Steadman & Simpson

[57] ABSTRACT

An apparatus for attaching a pair of fastener elements of a garment fastener to a garment fabric, comprises an optical indicator for designating a position of the garment fabric where the two fastener elements are to be attached. The indicator includes a light projector having a light source for projecting a beam of light, a reflector for reflecting the light beam downwardly, and means defining an aperture for the passage therethrough of the reflected light beam. An actuator is operatively connected to the light projector for reciprocating the same toward and away from a position where the aperture is in registry with a common vertical axis of the two fastener elements. The indicator is structurally and functionally separated from a pusher mechanism for supplying one fastener element to an upper unit of the apparatus. The indicator may include means for changing the color of the light beam projected from the light source so that a clear and distinctive light spot is produced on the garment fabric even when the latter has a color the same as or confusingly similar to the color of the light beam.

5 Claims, 9 Drawing Figures

BUTTON SETTING APPARATUS WITH OPTICAL POSITION INDICATOR

BACKGROUND OF THE INVENTION

1. Field of the Invention

The present invention relates generally to an apparatus for setting a garment fastener, such as a snap fastener, a button or an ornament, to a garment fabric, and more particularly to such a button setting machine having a device for indicating a correct location in alignment between a punch and a die of the button setting machine.

2. Prior Art

Various button setting device are known in which a pair of fastener elements is supported on a lower or die unit and an upper or a punch unit, respectively; a garment fabric is positioned between the upper and lower units with the aid of an indictor; and a punch of the upper unit moves toward a die of the lower unit to join the two fastener elements together in clinched condition with the garment fabric sandwiched between the two fastener elements.

U.S. Pat. No. 3,964,661, issued June 22, 1976 discloses one such button setting machine which includes an optical indicator constructed to produce a light spot on a garment fabric at a position where a pair of fastener elements is to be attached. The indicator comprises a light source fixed to a machine frame for projecting a horizontal light beam, and a mirror unit or reflector supported on the forward end of a slide bar so as to reflect the light beam downwardly at a 90° angle, the slide bar being reciprocably movable to advance one of the fastener elements below a punch of an upper unit. When the slide bar is fully advanced with the one fastener element carried on a forward step of the slide bar, the reflected light beam passes along a common vertical axis of the two fastener elements and hence the punch and a die. Since the mirror unit reciprocates in unison with the slide bar for a relatively long distance, the indicator as a whole requires a relatively large area for installation. Consequently, the button setting machine becomes large as a whole. Another disadvantage is that the mirror unit has a downwardly directed projection or pointer defining a channel for the passage of the reflected light. The projection is likely to interfere with the garment fabric while being set between the punch and the die with the result that positioning operation would be rendered tedious and time consuming. The prior indicator has another disadvantage in that correct positioning of the garment fabric is difficult to achieve when the garment fabric has the same or similar color as the light beam.

SUMMARY OF THE INVENTION

It is therefore an object of the present invention to provide a button setting apparatus having an optical indicator which can be assembled without increasing the whole size of the button setting apparatus, and which incorporates structural features to enable speedy and accurate positioning of a garment fabric with respect to a pair of fastener elements to be attached even when the color of the garment fabric is substantially the same as or confusingly similar to the color of a light beam projected from a light source.

According to the invention, an apparatus for attaching a pair of fastener elements of a garment fastener to a garment fabric, comprises an optical indicator for designating a position of the garment fabric where the two fastener elements are to be attached. The indicator includes a light projector having a light source for projecting a beam of light, a reflector for reflecting the light beam downwardly, and means defining an aperture for the passage therethrough of the reflected light beam. An actuator is operatively connected to the light projector for reciprocating at least the reflector and the aperture-defining means toward and away from a position where the aperture is in registry with a common vertical axis of a punch and a die of the apparatus. The indicator is structurally and functionally separated from a pusher mechanism for supplying one fastener element to the upper unit. The indicator may include means for changing the color of a light beam projected from the light source so that a clear and distinctive light spot is produced on the garment fabric even when the latter has a color which is the same as or confusingly similar to the color of the light beam.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
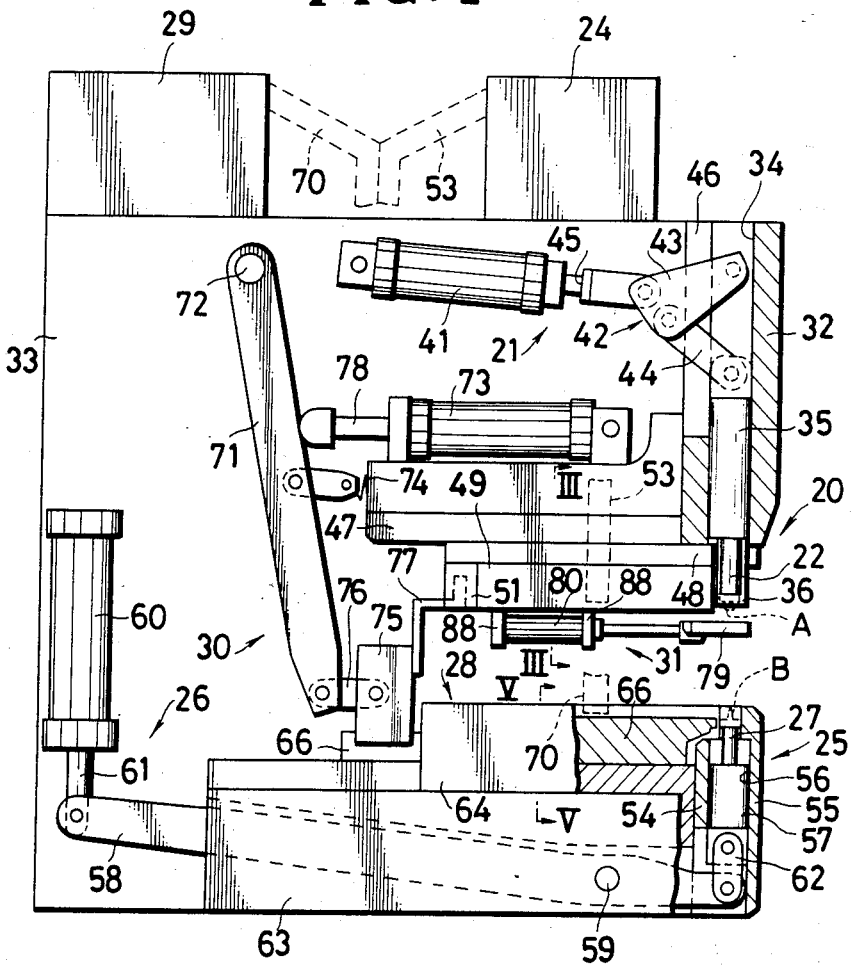
FIG. 1 is a side elevational view, with parts broken away, of an apparatus embodying the present invention.
Figure 9:
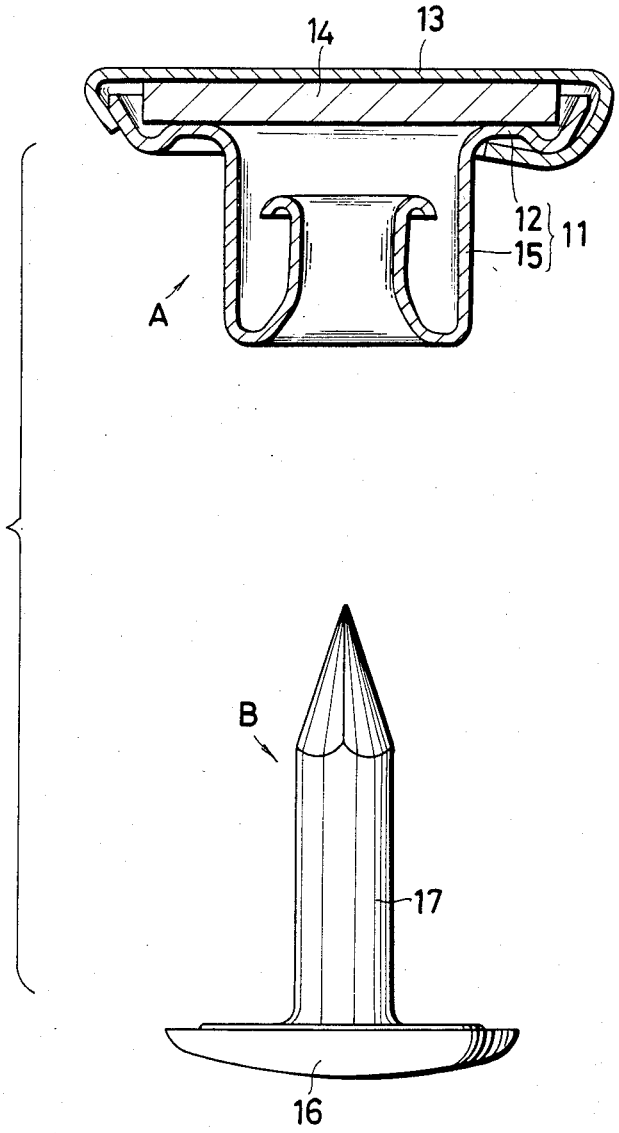
FIG. 9 is a front elevational view, partly in cross-section, of a pair of fastener elements to be joined together by the apparatus of FIG. 1.

FIG. 1 shows an apparatus for assembling a pair of first and second fastener elements A, B (illustrated in broken lines) in clinched condition with a garment (not shown) sandwiched therebetween. In the illustrated embodiment, the first and second fastener elements A, B comprise a button body and a tack, respectively, of a button. As best shown in FIG. 9, the button body A includes a button back 11 which has an annular rim 12 covered by a cap 13 with a circular back plate 14 disposed between the button back 11 and the cap 13. The button back 11 also has a hollow shank 15 in the form of a double tube projecting centrally from an inner edge of the annular rim 12. The tack B has a disc-like head 16 and a spike 17 projecting centrally therefrom for being forced through the garment fabric into the hollow shank 15 of the button back 11.

The apparatus comprises an upper or punch unit 20, a first drive mechanism 21 for vertically moving a punch 22 of the upper unit 20, a first pusher mechanism 23 (FIG. 3) for receiving a button body A at a time from a first parts feeder 24 and for supplying the button body A to the upper unit 20, a lower or die unit 25, a second drive mechanism 26 for vertically moving a die 27 of the lower unit 25, and a second pusher mechanism 28 for receiving a tack B at a time from a second parts feeder 29 and for supplying the tack B to the lower unit 25. The apparatus also comprises a third drive mechanism 30 operatively connected to the first and second pusher mechanisms 23, 28 for driving them in timed relation to each other, and an indicator 31 to facilitate correct positioning of the garment with respect to the button body A and the tack B for attachment thereof.

Figure 2:
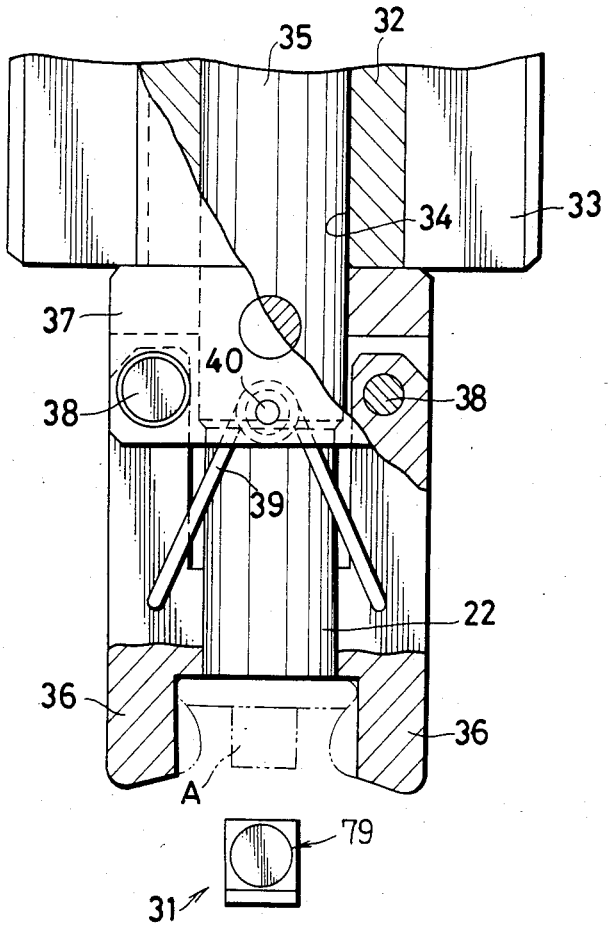
FIG. 2 is a fragmentary enlarged front elevational view, partly in cross section, of FIG. 1, showing an upper unit.

The upper unit 20 as shown in FIG. 2, includes a tubular head 32 secured to a frame 33 of the apparatus and having a vertical bore 34 and an upper plunger 35 reciprocable vertically within the vertical bore 34 in the head 32. The punch 22 is fixed to the lower end of the plunger 35. The upper unit 20 also includes a pair of clamp fingers 36, 36 for holding a button body A below the punch 22 when the button body A is supplied from the first pusher mechanism 23 to the clamp fingers 36, 36. The clamp fingers 36, 36 are pivoted at their upper ends on to a support block 37 by means of a pair of pins 38, 38, respectively. The support block 37 is movably mounted on the head 32 and is operatively connected to the plunger 35 for limited vertical movement therewith. A torsion spring 39 is supported on the support block 37 by a pin 40 and acts on the clamp fingers 36, 36 to normaly urge them toward each other for clamping the button body A.

The first drive mechanism 21, as shown in FIG. 1, includes a first fluid actuator such as an air cylinder 41 and a toggle joint 42 composed of a pair of first and second levers 43, 44, the first air cylinder 41 being pivotably supported on the frame 33. The first lever 43 is pivotably connected at its one end to the head 32 and is pivotably connected at the other end to a piston rod 45 of the air cylinder 41, while the second lever 44 is pivotably connected at opposite ends to the first lever 43 and the upper end of the plunger 35. For connection, the levers 43, 44 extend into the vertical bore 34 through a vertical slot 46 in the head 32.

Figure 3:
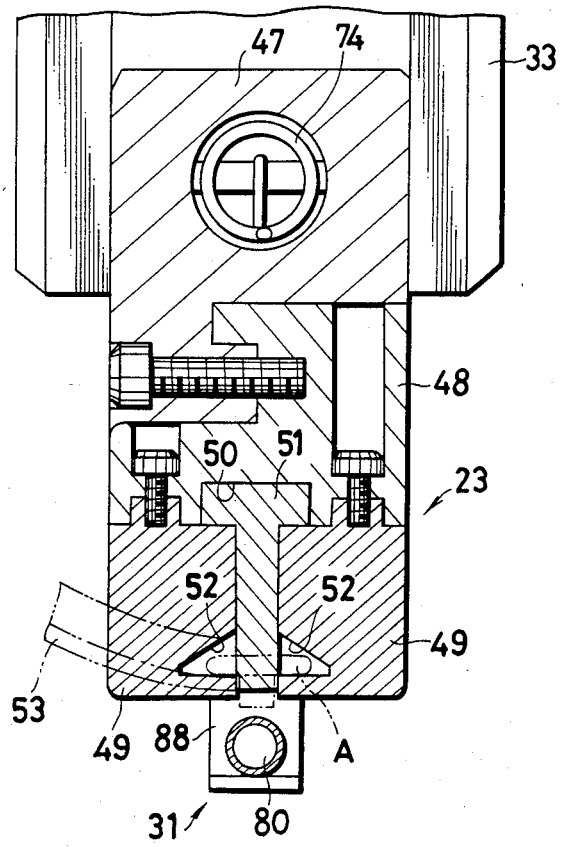
FIG. 3 is an enlarged cross-sectional view taken along line III—III of FIG. 1.

The first pusher mechanism 23, as shown in FIG. 3, includes a horizontal support block 47 secured to the frame 33, an elongated guide block 48 secured to the underside of the support block 47, and a pair of parallel spaced guides 49, 49 secured to the underside of the guide block 48. The guide block 48 and the two guides 49, 49 jointly define therebetween a longitudinal guide channel 50 of a T-shaped cross-section, in which a first elongated pusher bar 51 of a T-shaped cross-section is slidably received. The two guides 49, 49 have in their inner surfaces a pair of elongated recesses or grooves 52, 52 for guiding the head portion of a button body A. The pusher bar 51 is fully advanced while the punch 22 is fully retracted and, in response to descending movement of the punch 22, it moves to a retracted position along the guide channel 50.

A first chute 53 is connected at its upper end with the first parts feeder 24 and, as shown in FIG. 3, it has a lower end extending through the left guide 49 and communicating with the groove 52 in the left guide 49 for delivering successive button bodies A from the first parts feeder 24 to the grooves 52. While the pusher bar 51 is in the advanced position, a leading one of the successive button bodies A is prevented from entering the groove 52. When the forward end of the pusher bar 51 is disposed behind the lower end of the chute 53 as the pusher bar 51 is fully retracted, the leading button body A slides into the grooves 52, 52 with its shank directed downwardly. As the pusher bar 51 is moved forwardly, the leading button body A is pushed along the grooves 52, 52 by the pusher bar 51 and then is gripped by the clamp fingers 36, 36 under the bias of the torsion spring 39 (FIG. 2). During that time, entering of the succeeding button body A into the grooves 52, 52 is prevented by the pusher bar 51. Thus the successive button bodies A are supplied one at a time to the first pusher mechanism 23.

Figure 4:
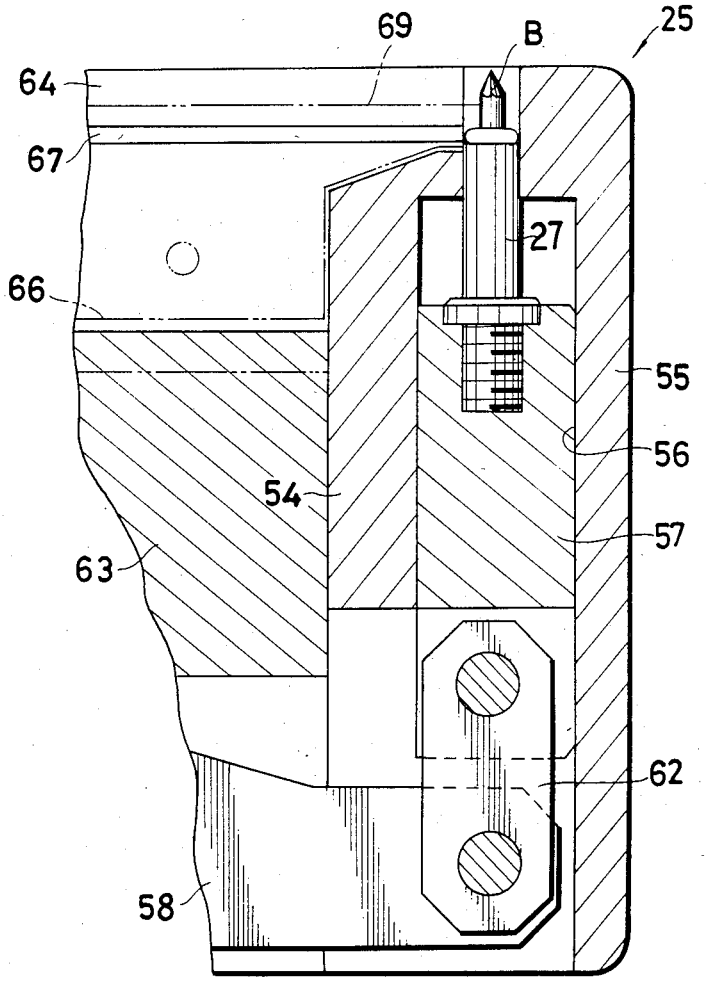
FIG. 4 is a fragmentary enlarged vertical cross-sectional view of FIG. 1, showing a lower unit.

As shown in FIGS. 1 and 4, the lower unit 25 includes a base 54 fixedly supported on the frame 33, and a support block 55 fixed to the base 54, the base 54 and the support block 55 jointly defining therebetween a vertical bore 56 within which a lower plunger 57 is vertically movable. The die 27 is fixed to the upper end of the lower plunger 57. The lower plunger 57 is operatively connected to the second drive mechanism 26.

The second drive mechanism 26, as shown in FIG. 1, includes a third lever 58 pivotably supported on the frame 33 by means of a pin 59, and a second fluid actuator such as an air cylinder 60 fixed to the frame 33. The third lever 58 is pivotably connected at one end thereof to a piston rod 61 of the air cylinder 60. The other end of the third lever 58 is connected to the lower end of the lower plunger 57 via a link 62. The piston rod 61 is normally held in its retracted position. When the air cylinder 60 is actuated to extend its piston rod 61, the third lever 58 is pivotally moved counterclockwise to raise the lower plunger and the die 27.

Figure 5:
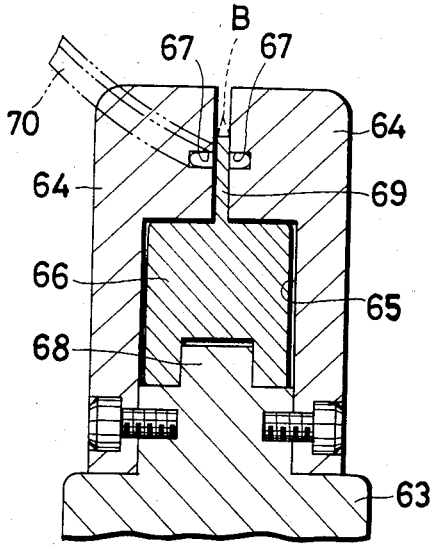
FIG. 5 is an enlarged cross-sectional view taken along line V—V of FIG. 1.

As shown in FIGS. 1, 4 and 5, the second pusher mechanism 28 includes a second elongated guide base 63 fixedly supported by the frame 33, a pair of parallel guide plates 64, 64 secured to the upper side of the guide base so as to define therebetween a longitudinal guide channel 65 of an inverted T-shaped cross-section, and a second elongated pusher bar 66 of an inverted T-shaped cross-section slidably received in the guide channel 65. The two guide plates 64, 64 have in their inner surfaces a pair of guide groove 67, 67 for guiding the disc-like head portion of the tack B. The pusher bar 66 is mounted on a guide ridge 68 on the upper surface of the guide base 63 and has an upper pushing fin 69 received in a narrow upper portion of the inverted T-shaped guide channel 65, the fin extending across the guide grooves 67, 67.

A second chute 70 is connected at its upper end to the second parts feeder 29 and, as shown in FIG. 5, it has a lower end extending through the left guide plate 64 and communicating with the groove 67 in the left guide plate 64 for delivering successive tacks B from the second parts feeder 29 to the grooves 67, 67. While the pusher bar 66 is in its fully advanced position, a leading one of the successive tacks B is prevented from entering the groove 67 by means of the pushing fin 69. When the forward end of the pusher bar 66 is disposed behind the lower end portion of the chute 70 as the pusher bar 66 is fully retracted, the leading tack B slides into the grooves 67 with its spike directed upwardly. As the pusher bar 66 is moved forwardly, the leading tack B is pushed along the grooves 67, 67 by the pushing fin 69 and then is placed on the die 27. During that time, entering of the succeeding tack B into the grooves 67 is prevented by the pushing fin 69 of the pusher bar 66 so that the successive tacks B are supplied one at a time to the second pusher mechanism 28.

The first pusher mechanism 23 and the second pusher mechanism 28 are driven in timed relation to each other by the third drive mechanism 30. As shown in FIG. 1, the third drive mechanism 30 includes a fourth lever 71 having an upper end pivotably supported on the frame 33 by means of a pin 72, a third fluid actuator or an air cylinder 73 fixed to the support block 47 for actuating the fourth lever 71 to pivot about the pin 72, a tension spring 74 acting between the support block 47 and the fourth lever 71 to normally urge the latter toward the third air cylinder 73, and a pushing block 75 connected to a lower end of the fourth lever 71 via a link 76. The first pusher bar 51 of the first pusher mechanism 23 is connected to the pushing block 75 by a connector 77, while the second pusher bar 66 of the second pusher mechanism 28 is connected directly to the pushing block 75.

The piston rod 78 of the third air cylinder 73 is normally retracted so that the first and second pusher bars 51, 66 normally assume their advanced positions under the bias of the tension spring 74. Then, as the piston rod 78 of the air cylinder 73 projects, the fourth lever 71 pivots clockwise in FIG. 1 about the pin 72 to cause the first and second pusher bars 51, 66 to be moved to their retracted positions, thus allowing a successive button body A and a successive tack B to be delivered into the guide grooves 52, 67 in front of the first and second pusher bars 51, 66, respectively. When the air cylinder 73 is actuated to retract the piston rod 78, the fourth lever 71 pivots counterclockwise in FIG. 1 about the pin 72 under the bias of the tension spring 74 to cause the first and second pusher bars 51, 66 to be moved to their advanced positions for placing the successive button body A and the successive tack B, respectively, under the punch 22 and on the die 27.

Figure 6:
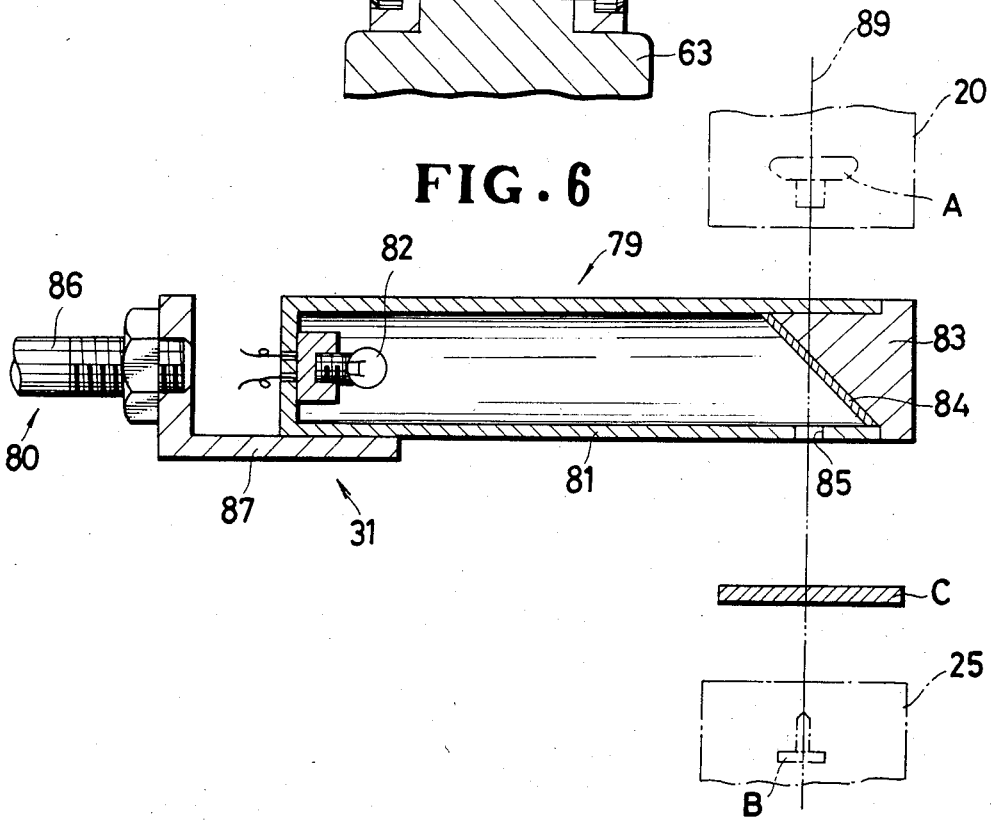
FIG. 6 is a fragmentary enlarged cross-sectional view of FIG. 1, showing an indicator.

The indicator 31 is of the optical type and comprises a light projector 79, and an actuator 80 operatively connected to the light projector 79 is for reciprocating the latter to an advanced position where the light projector 79 disposed below the upper unit 20, and a retracted position remote from the upper unit 20. The light projector 79, as shown in FIG. 6, includes a tubular housing 81, a light source such as a lamp 82 disposed in the housing 81 at one end thereof, a plug 83 fitted to the other end of the housing 81 to close the same, and a mirror or reflector 84 supported on the plug 83 in alignment with the light source 82, the reflector 84 being tilted toward the light source 82 substantially at an angle of 45 degrees to reflect a light beam from the light source 82 downwardly at a 45° angle. The housing 81 has in its circumferential wall an apperture 85 for the passage of the reflected light beam.

The actuator 80, as illustrated in FIGS. 1 and 6, comprises an air cylinder having a piston rod 86 connected to an L-shaped support 87 on which the light projection 79 is supported. The air cylinder 80 is fixedly supported on the underside of the guides 49 of the first pusher mechanism 23 by means of a pair of support blocks 88, 88. The air cylinder 80 operates in timed relation to the reciprocating movement of the punch 22 of the upper unit 20. Namely, when the punch 22 is fully retracted, the air cylinder 80 extends its piston rod 86 to move the light projector 79 from the retracted position to the advanced position of FIG. 6 where the reflected light beam projected from the hole 85 passes along a common vertical axis 89 of the button body A on the upper unit 20 and the tack B on the lower unit 25. Thus, a light spot is produced on a garment fabric C when the latter is disposed between the button body A and the tack B. Immediately before the descending movement of the punch 22, the air cylinder 80 retracts its piston rod 86 to move the projector 79 away from the upper unit 20.

The apparatus thus constructed operates as follows: For the purposes of illustration, operation of the apparatus begins from a condition shown in FIG. 1 where the piston rods 45, 61, 78 of the first, second and third air cylinders 41, 60, 73 are retracted, while the piston rod 86 (FIG. 6) of the air cylinder 80 is extended. Thus, the punch 22 and the die 27 are fully retracted, while the first and second pusher bars,, 51, 66 are fully advanced so that a button body A is hedld by the clamp fingers 36, 36 below the punch 22 and a tack B is placed on the die 27. The light projector 79 of the indicator 31 assumes its advanced position and the light beam projected from the hole 85 passes along the common vertical axis 89 of the button body A and the tack B. The light beam produces a light spot on a garment fabric when the latter is disposed between the upper and lower units 20, 25.

After a position on the garment fabric where the button body A and the tack B are to be attached has been set in registry with the light spot, the air cylinder 80 is actuated to retract its piston rod 86 and hence the light projector 79 connected thereto, away from the upper unit 20. Then the third air cylinder 73 is actuated to extend its piston rod 78 whereupon the fourth lever 71 pivots clockwise (FIG. 1) to cause the first and second pusher arms 51, 66 to be moved to their retracted position. Thereafter, the first air cylinder 41 is actuated to extend its piston rod 45 whereupon the toggle link 42 extends its levers to thereby lower the punch 22 and the clamp fingers 36 toward the die 27 with the button body A held by the clamp fingers 36. Immediately after the activation of the first cylinder 41, the second cylinder 60 is actuated to extend its piston rod 61. This movement of the piston rod 61 causes the third lever 68 to pivot counterclockwise (FIG. 1) whereby the die 27 moves upwardly toward the punch 22 while supporting the tack B thereon. Thus, the button body A and the tack B are attached to the garment fabric C accurately at the desired position.

Then the first, second and third air cylinders 41, 60, 73 are actuated to retract their piston rods 45, 61, 78, while the air cylinder 80 is actuated to extend its piston rod 86, whereby the components 22, 25, 51, 66, 79 return to their position of FIG. 1.

Figure 7:
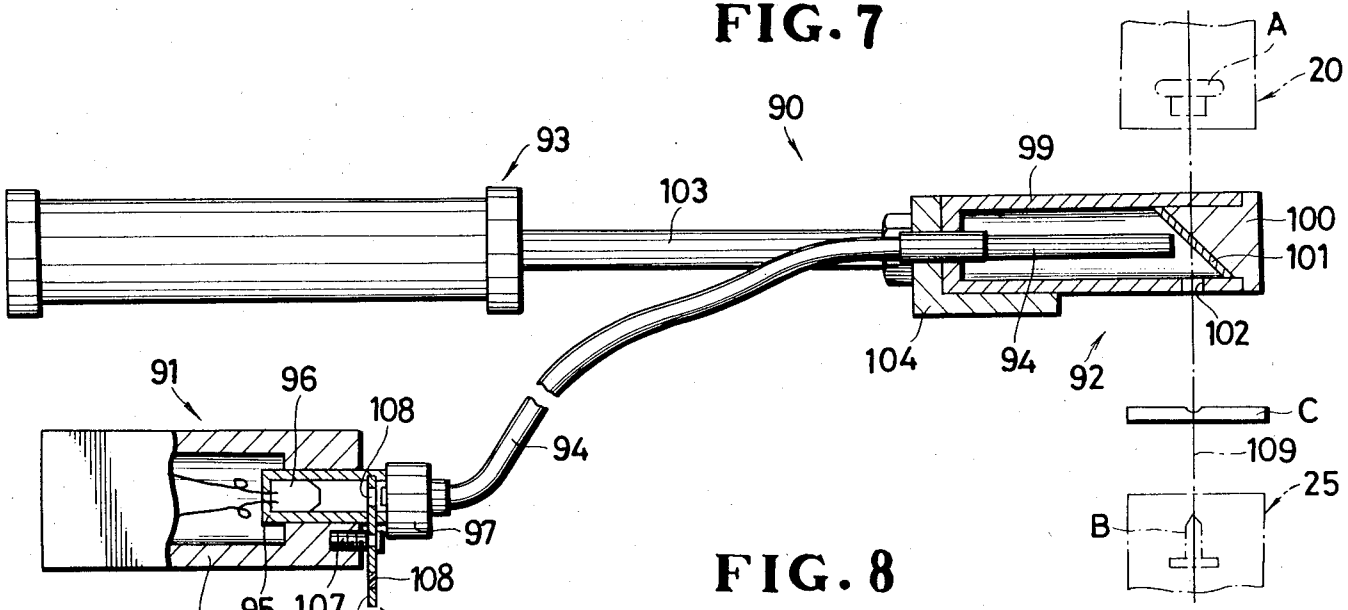
FIG. 7 is a fragmentary enlarged side elevational view, partly in cross section, of a modified indicator.

FIG. 7 shows a modified indicator 90 according to the invention. The indicator 90 includes a light generating unit 91, a light reflecting unit 92, an actuator 93 for reciprocating the light reflecting unit 92, and an optical fiber 94 optically interconnecting the light generating unit 91 and the light reflecting unit 92, the two units 91, 92 jointly constituting a light projector.

The light generating unit 91 includes a tubular housing 95 and a light source such as a lamp 96 disposed in the housing 95 at one end of the same. The other end of the housing 95 is closed by a plug 97 to which one end of the optical fiber 94 is fitted with the one end facing toward the light source 96. The housing 95 is mounted on a support block 98 secured to the frame 33 of the button setting apparatus.

The light reflecting unit 92 includes a tubular housing 99 having one end closed by a plug or cover 100, and a mirror or reflector 101 disposed in the housing 99 and supported on the plug 100. The other end portion of the optical fiber 94 is fitted with the other end of the housing 99 and extends therethrough toward the reflector 101 in alignment with the latter so as to transmit a beam of light projected from the light source 96 to the reflector 101. The reflector 101 is tilted toward the other end of the optical fiber 94 substantially at an angle of 45 degrees to reflect the light beam from the optical fiber 94 downwardly at a 45° angle. The housing 99 has in its circumferential wall an aperture or hole 102 for the passage of the reflected light beam.

The actuator 93 comprises an air cylinder having a piston rod 103 connected to an L-shaped support 104 on which the housing 99 of the light reflecting unit 92 is supported. The air cylinder 93 operates in timed relation to the reciprocating movement of the punch 22 of the upper unit 20. Namely, when the punch 22 is fully retracted, the air cylinder 93 extends its piston rod 103 to move the light reflecting unit 92 from a retracted position remote from the upper unit 20, to an advanced position of FIG. 7 where the reflected light projected from the hole 102 passes along a common vertical axis 109 of a button body A and a tack B supported respectively on the upper and lower units 20, 25. Thus, a light spot is produced on a garment C when the latter is disposed between the upper and lower units 20, 25.

Figure 8:
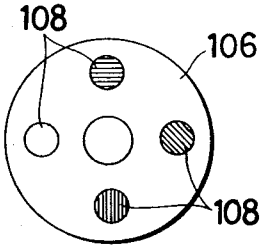
FIG. 8 is an enlarged plan view of an optical filter mounted on the indicator shown in FIG. 8.

The indicator 90 further includes means for selectively changing the color of the light beam projected from the light source 96. The color changing means, as shown in FIG. 8, comprises a circular disc 106 having a plurality (four being shown in the illustrated embodiment) of concentric light-transmittable portions 108 spaced circumferentially at equal intervals. The disc 106 is rotatably mounted on the mounting block 98 in eccentric relation to the tubular housing 95. The disc 106 is partly received in the housing 95 between the light source 96 and the end of the optical fiber 94 such that when the disc 106 rotated the light-transmittable portions 108 pass successively across the light beam fed from the light source 96 to the optical fiber 94. As shown in FIG. 8, one of the light-transmittable portions 108 comprises an aperture, and the remaining portions 108 comprise color filters of different colors (blue, green and red), respectively, the filters preferably being made of a colored plastic film (FIG. 7). Thus, the light beam projected from the light source 96 changes in color as it passes, through,. the light transmittable portions 108. accordingly the light spot produced on the garment C is distinctive and can be observed even when the color of the garment fabric C is the same as or confusingly similar to the color of the light beam.

The indicator 90 operates in the same manner as the indicator shown in FIG. 6 at 31 and no description is necessary. The color-changing means 105 may be mounted on the light projector 79 of the indicator 31 shown in FIG. 6.

The indicators 31, 90 have various advantages as follows: The stroke of reciprocation of the light projector 79 (FIG. 6) or the light reflecting unit 92 (FIG. 7) is relatively short because it is driven by the actuator 80, 93 independent of the actuator of the first pusher mechanism 23. Accordingly, the provision of the indicator 31, 90 does not increase the whole size of the button attaching apparatus. Neither the light projector 79 or the light reflecting unit 92 has any projection which would interfere with a garment fabric during placement of the latter. Thus the garment fabric can be set quickly with utmost ease. With the color-changing means 105, the light spot produced on the garment fabric C is always clear and distinctive even when the garment fabric has a color substantially the same as or confusingly similar to the color of the light source 82, 96. The indicator is structurally and operationally separated from the first pusher machanism and hence it operates reliably for a relatively long period of time and is easy to maintain.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for attaching a pair of fastener elements of a garment fastener to a garment fabric, comprising:

(a) a frame;

(b) a pair of vertically aligned upper and lower units supported by said frame for receiving the respective fastener elements, said lower unit having a die, said upper unit having a punch reciprocably movable toward and away from said die to join the two fastener elements together with the garment fabric sandwiched therebetween;

(c) a pusher mechanism for supplying one fastener element at a time to said upper unit;

(d) a first actuator mounted on said frame for driving said pusher mechanism; and (e) means for indicating a position on the garment fabric where the two fastener elements are to be attached, said indicating means including (1) a tubular housing having therein a light source for projecting a beam of light, and a reflector for reflecting the light beam dowardly, and an aperture in a circumferential wall of said tubular housing below said reflector for the passage therethrough of the reflected light beam, and (2) a second actuator operatively connected to said tubular housing for reciprocating it toward and away from said position where said aperture is in registry with a common vertical axis of said punch and said die.

2. An apparatus for attaching a pair of fastener elements of a garment fastener to a garment fabric, comprising:

(a) a frame;

(b) a pair of vertically aligned upper and lower units supported by said frame for receiving the respective fastener elements, said lower unit having a die, said upper unit having a punch reciprocably movable toward and away from said die to join the two fastener elements together with the garment fabric sandwiched therebetween;

(c) a pusher mechanism for supplying one fastener element at a time to said upper unit;

(d) a first actuator mounted on said frame for driving said pusher mechanism; and (e) means for indicating a position on the garment fabric where the two fastener elements are to be attached, said indicating means including (1) a light source fixedly mounted in a fixed housing on said frame for projecting a beam of light, (2) a tubular housing having therein a reflector for reflecting the light beam downwardly, and an aperture in a circumferential wall of said tubular housing below said reflector for the passage therethrough of the reflected light beam, (3) an optical fiber interconnecting said fixed light source housing and said tubular housing for optically conducting said beam of light to said reflector, and (4) a second actuator operatively connected to said tubular housing for reciprocating it toward and away from said position where said aperture is in registry with a common vertical axis of said punch and said die.

3. An apparatus for attaching a pair of fastener elements of a garment fastener to a garment fabric, comprising:

(a) a frame;

(b) a pair of vertically aligned upper and lower units supported by said frame for receiving the respective fastener elements, said lower unit having a die, said upper unit having a punch reciprocably movable toward and away from said die to join the two fastener elements together with the garment fabric sandwiched therebetween;

(c) a pusher mechanism for supplying one fastener element at a time to said upper unit;

(d) a first actuator mounted on said frame for driving said pusher mechanism; and (e) means for indicating a position on the garment fabric where the two fastener elements are to be attached, said indicating means including (1) a light projector having a light source for projecting a beam of light, a reflector for reflecting the light beam downwardly, and means defining an aperture for the passage therethrough of the reflected light beam, (2) a second actuator operatively connected to said light projector for reciprocating at least said reflector and said aperture-defining means toward and away from said position where said aperture is in registry with a common vertical axis of said punch and said die, and (3) means for selectively changing the color of the light beam projected from said light source.

4. An apparatus according to claim 3, said color changing means comprising a circular disc having a plurality of circumferentially spaced light-transmittable portions and rotatably disposed between said light source and said reflector such that each said light-transmittable portion passes across the light beam fed from the light source when said disc is rotated, at least one of said light-transmittable portions comprising an aperture and each remaining light-transmittable portion comprising a colored plastic film.

5. An apparatus according to claim 4, including a housing fixedly mounted on said frame and containing said light source at one end thereof, and an optical fiber optically interconnecting said light source and said reflector to transmit the light beam fed from said light source to said reflector, said optical fiber having an end fitted with the other end of said housing, said disc being disposed between said light source and said end of said optical fiber.

* * * * *